US006202258B1

(12) United States Patent
Winn

(10) Patent No.: US 6,202,258 B1
(45) Date of Patent: Mar. 20, 2001

(54) APPARATUS AND RELATED METHOD FOR APPLYING MOISTURE TO COTTON DURING A GINNING OPERATION

(76) Inventor: William E. Winn, 1301 First St., Levelland, TX (US) 79336

( * ) Notice: Subject to any disclaimer, the term of this patent is extended or adjusted under 35 U.S.C. 154(b) by 0 days.

(21) Appl. No.: 09/389,016

(22) Filed: Sep. 2, 1999

Related U.S. Application Data

(60) Provisional application No. 60/099,112, filed on Sep. 3, 1998, and provisional application No. 60/102,089, filed on Sep. 29, 1998.

(51) Int. Cl.[7] ..... D01B 3/04
(52) U.S. Cl. ..... 19/66 CC; 19/39; 68/5 D
(58) Field of Search ..... 19/39, 65 A, 66 CC, 19/66 R; 68/5 D, 5 E

(56) References Cited

U.S. PATENT DOCUMENTS

| | | | | |
|---|---|---|---|---|
| T975,001 | * | 10/1978 | Mangialardi, Jr. et al. | 19/66 CC |
| 2,019,079 | * | 10/1935 | Herring | 19/66 CC |
| 2,312,557 | * | 3/1943 | Joyce | 19/66 CC |
| 2,747,234 | * | 5/1956 | Speakes et al. | 19/66 CC |
| 4,021,887 | * | 5/1977 | Jackson | 19/66 R |
| 4,031,593 | * | 6/1977 | Vandergriff | 19/66 CC |
| 4,103,397 | | 8/1978 | Jackson . | |
| 4,140,503 | | 2/1979 | Vandergriff . | |
| 4,143,470 | * | 3/1979 | Vandergriff | 19/66 CC |
| 4,943,300 | * | 7/1990 | Vinnikov | 19/66 CC |
| 4,999,881 | | 3/1991 | Vandergriff et al. . | |
| 5,381,587 | | 1/1995 | Vandergriff . | |
| 5,668,479 | | 9/1997 | Jackson et al. . | |
| 5,892,142 | | 4/1999 | Ghorashi et al. . | |
| 5,907,394 | | 5/1999 | Ghorashi et al. . | |

* cited by examiner

*Primary Examiner*—John J. Calvert
*Assistant Examiner*—Gary L. Welch
(74) *Attorney, Agent, or Firm*—Finnegan, Henderson, Farabow, Garrett & Dunner, L.L.P.

(57) ABSTRACT

Apparatus and related method for adding moisture to cotton using humid air, comprising a tower casing defining a chamber having top and bottom portions, a first inlet proximate the top portion of the tower casing for receiving the cotton, an outlet proximate the bottom portion, a cotton conveying passage connecting the first inlet to the outlet, and a second inlet to the top portion for receiving the humid air. The related method comprising the steps of introducing cotton lint into a chamber, introducing humid air at an elevated temperature into the chamber, and exposing the cotton lint to the humid air while gradually reducing the temperature.

11 Claims, 2 Drawing Sheets

APPARATUS AND RELATED METHOD FOR APPLYING MOISTURE TO COTTON DURING A GINNING OPERATION

RELATED APPLICATIONS

This patent application claims priority to Provisional U.S. patent application Ser. No. 60/099,112, entitled "Apparatus and Related Method for Applying Moisture to Cotton During the Ginning Operation", filed on Sep. 3, 1998, and Provisional U.S. patent application Ser. No. 60/102,089, entitled "Apparatus and Related Method for Applying Moisture to Cotton During the Ginning Operation", filed on Sep. 29, 1998, which are herein incorporated by reference.

BACKGROUND OF THE INVENTION

1. Field of the Invention

The present invention is related to cotton gins. More particularly, the present invention relates to a method and apparatus for increasing the moisture content of cotton during a cotton ginning process.

2. Description of the Related Art

Since it was invented by Eli Whitney more than a century ago, the cotton gin has remained the primary tool used to remove extraneous material, more commonly known as "trash," from newly-picked cotton. The "trash" removed typically includes seeds and other parts of the cotton plant that are collected together with the raw cotton when it is harvested. This "trash" must be separated from the cotton fibers before the fibers can be processed into thread and, ultimately, into fabric.

Cotton, however, is not ginned immediately after it is picked. Instead, among other pre-ginning processes, high moisture seed cotton is first partially dried in various types of apparatus known as a tower dryer or a seed cotton dryer of some other type. The tower dryer is a direct application of the knowledge that cotton is more easily ginned when it has a low moisture content.

To dry cotton, the conventional tower dryer includes a vertical tower casing, with substantially parallel shelf partitions. These shelf partitions alternately extend from one end wall of the tower casing to a location near the opposite end wall. So configured, the shelf partitions define a continuous zig-zag passage through the tower casing that guarantees a sufficient amount of drying by ensuring that the cotton remains in the dryer for a selected period of time at a desired temperature or range of temperatures.

In the conventional seed cotton dryer, cotton and heated air initially enter the tower dryer through an inlet, located proximate to the top of the tower casing. The heated air carries the cotton through the sinuous passage in the dryer to the outlet. As the cotton, which may have an initial moisture content of between about 15% to 20%, passes through the dryer, moisture is progressively driven from the cotton until the cotton exits the dryer with a moisture content as low as 0%. The desired range of moisture content for cotton before cleaning is about 5½% to 6½%.

After removing the trash from the seed cotton, the cotton is now substantially free of seeds and trash. At this stage the cleaned cotton is referred to as cotton lint. After drying the cotton to facilitate cleaning of the cotton, it usually will have a moisture content lower than 8%. It often will have moisture content of about 3 or 4%. This level of moisture content facilitates cleaning, but it is lower than the ideal moisture content for processing the cotton through the batting stage and for the final product.

It is lower than desired because low moisture content causes mechanical problems and stress on the cotton bale press tamper and ram. Added moisture allows the cotton to flow through the battery condenser more easily, as cotton too dry and fluffy can cause mechanical problems, and relieves the strain on the cotton bale press tramper and the cotton bale press ram. Higher moisture contents also reduces billowing of the cotton when the cotton bale is opened; billowing increasing the processing cost of making cotton fibers into fabric.

Typical methods used to add moisture to cotton are described in U.S. Pat. No. 4,140,503 granted to Vandergriff and U.S. Pat. No. 4,103,397 granted to Jackson. These patents show systems that add moisture to the cotton while the cotton lint is within a battery condenser or after the cotton has been condensed. One of the problems with these and other conventional systems is that they do not raise the moisture level sufficiently if the initial moisture content of the cotton is very low. Further, the humid air for these systems is added to a structure that is at a relatively low temperature. Because of this low temperature, the humid air condenses on the parts of the structure. Water condensed on the surfaces that cotton comes into contact with will impede the progress of the cotton, making the cotton stick to the areas where the water has condensed. Also, these systems do not do a good job of regulating the moisture content of the cotton, thereby allowing the moisture of the content to vary from the ideal post-cleaning moisture content of 8%.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises a method of increasing the moisture content of cotton, comprising the steps of introducing cotton lint into a chamber, introducing humid air at an elevated temperature into the chamber, and exposing the cotton lint to the humid air while gradually reducing the temperature. Also to attain the advantages and in accordance with the purpose of the invention, as embodied and broadly described herein, the invention comprises an apparatus for adding moisture to cotton using humid air, comprising a tower casing defining a chamber having top and bottom portions, a first inlet proximate the top portion of the tower casing for receiving the cotton, an outlet proximate the bottom portion, a cotton conveying passage connecting the first inlet to the outlet, and a second inlet to the top portion for receiving the humid air.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENT

Reference will now be made in detail to the present preferred embodiments of the invention, an example of which is illustrated in the accompanying drawings. Wherever possible, the same reference numbers will be used throughout the drawings to refer to the same or like parts.

In accordance with the present invention, a method of increasing the moisture content of cotton comprises the steps of introducing cotton lint into a chamber, introducing humid air at an elevated temperature into the chamber, and exposing the cotton lint to the humid air while gradually reducing the temperature.

Figure 1:
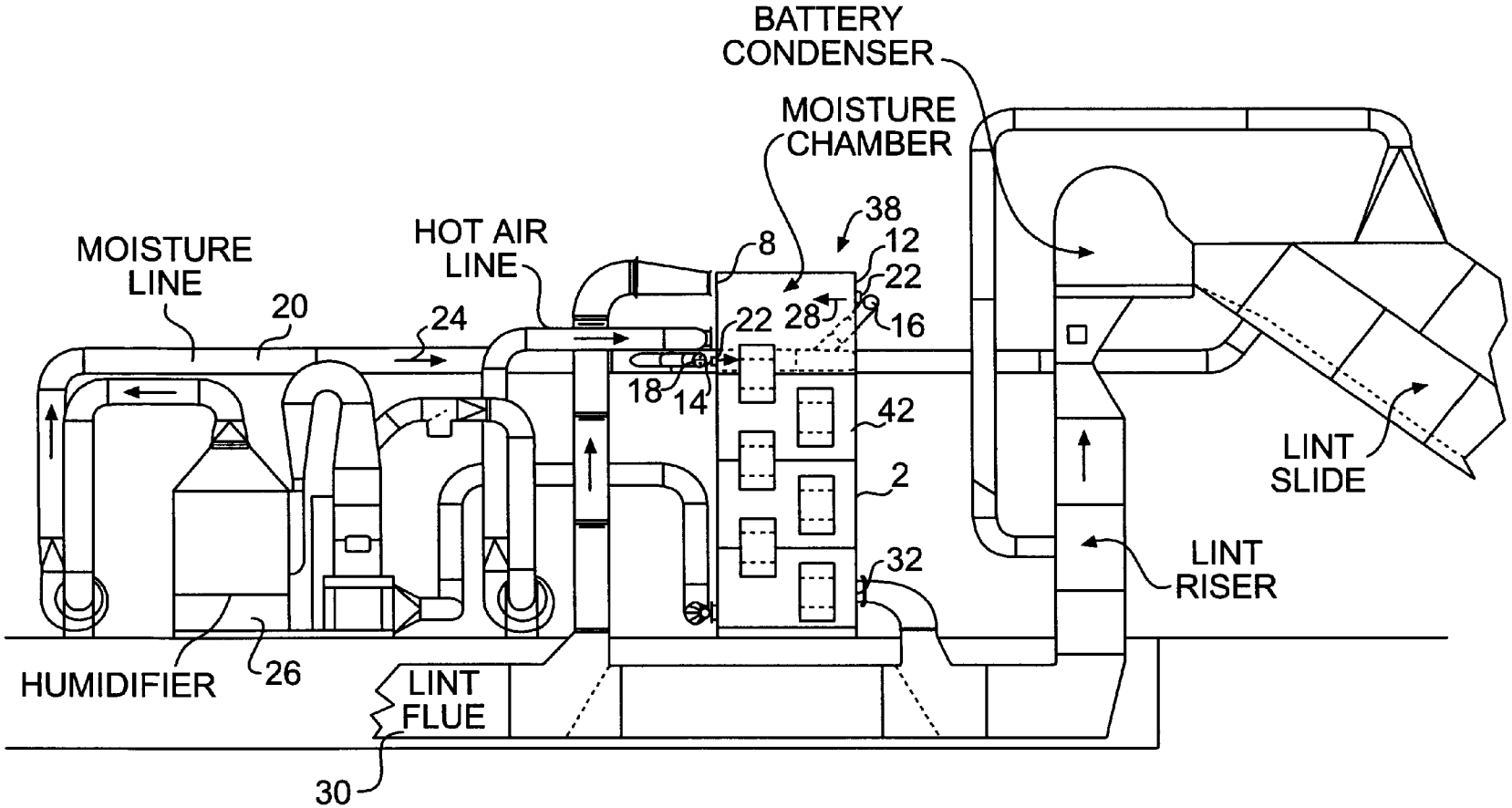
FIG. 1 is a side view, depicting a ginning operation after cotton has been cleaned of trash.
Figure 2:
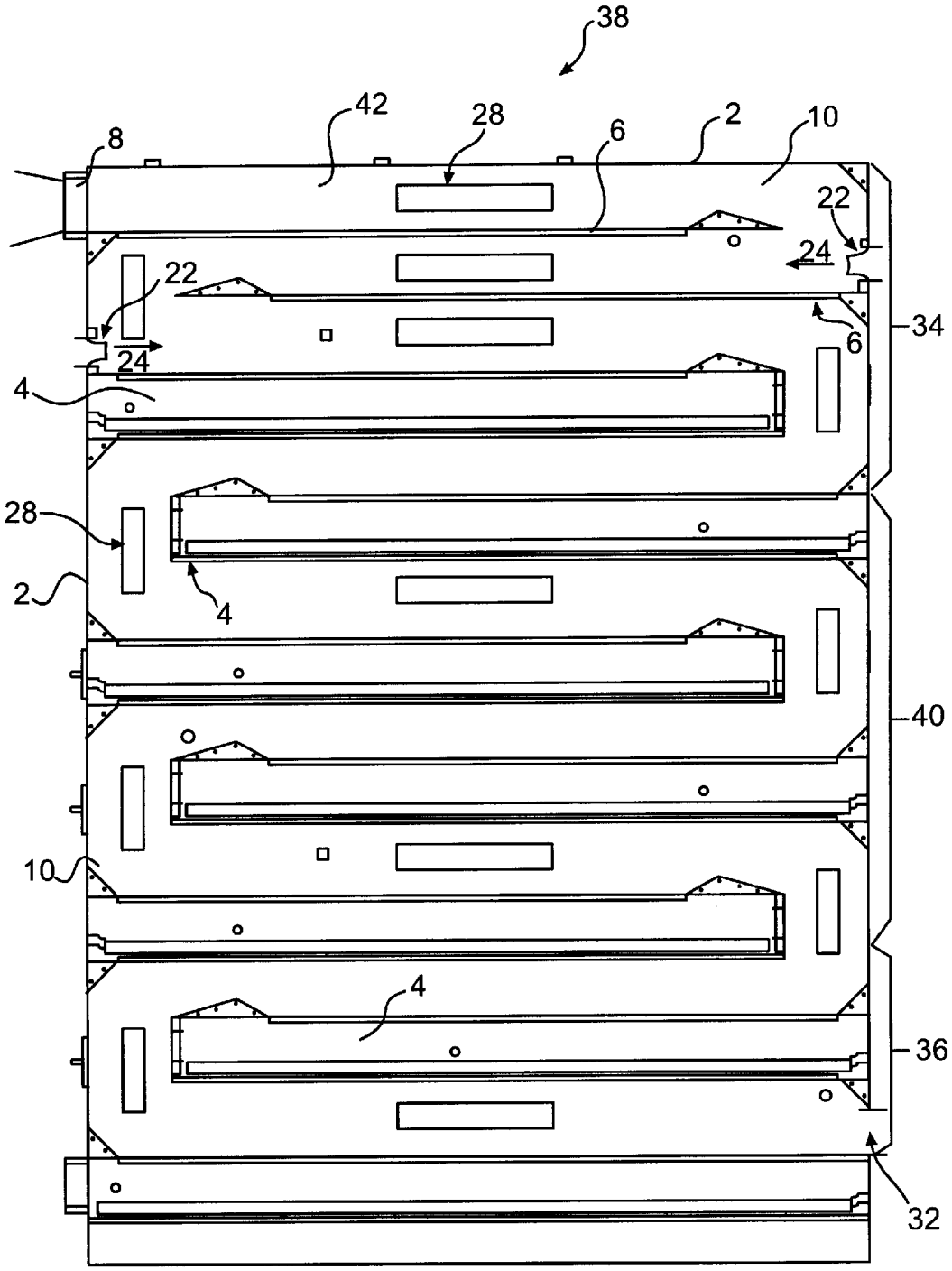
FIG. 2 is a side view, depicting the hot shelf moisture tower.

In the preferred embodiment shown in FIGS. 1 and 2, cotton lint is introduced through lint flue 30 into chamber 42 of moisture tower 38. After entering chamber 42 the cotton lint progresses through three regions of chamber 42: top portion 34, middle portion 40, and bottom portion 36. As the cotton lint advances through the regions it travels within passage 10. Passage 10 is a sinuous track defined by first shelves 6 and second shelves 4 which alternately project into chamber 42.

Preferably, the cotton lint is introduced into top portion 34 and exits out of bottom portion 36 traveling a flow path governed by passage 10 because, by following this path, the cotton lint gains, in a controlled fashion, moisture from humid air 24 blown into top portion 34. Condensation is controlled by setting the temperatures of each portion and of second shelves 4. Top portion 34 is heated to a first temperature which is high enough for humid air 24 to retain its moisture. As humid air 24 travels with the cotton lint through middle portion 40, which is not as hot as top portion 34, humid air 24 begins to cool. The temperature within the regions controls how fast humid air 24 cools, and thus, how quickly the moisture within humid air 24 condenses. By monitoring numerous heating parameters, such as the speed and temperature of the hot air pumped through hot air conduits 28, the temperature of the ambient air which cools casing 2, and the temperature of second shelves 4, a temperature gradient is maintained, preferably a 50° F. gradient between top portion 34 and bottom portion 36. This temperature gradient dictates the rate at which humid air 24 releases its moisture. In this way control is exercised over the amount of water vapor available for absorption by the cotton lint.

In conjunction with the temperature gradient, second shelves 4 are heated. They are heated so that the cotton lint will not stick to them. As humid air 24 and the cotton lint advance and cool from top portion 34 to bottom portion 36 through passage 10 moisture condenses from humid air 24. The moisture will condense first on the coolest available object; by heating second shelves 4 the cotton lint is generally the coolest available object. Thus, the moisture within humid air 24 condenses on the cotton lint, and, to a large extent, not on second shelves 4. Because the moisture does not condense on second shelves 4, the cotton lint gains more moisture than it would otherwise and water does not build up on second shelves 4. When water builds up on second shelves 4, especially if the steel is cool, the cotton lint sticks to them. By heating shelves 4 the cotton travels more easily because moist cotton slides over hot steel more easily than cool steel. In sum, heating second shelves 4 allows the cotton lint to gain a large amount of water, which the cotton lint quickly absorbs, while traveling easily through passage 10.

Specifically, the temperature gradient is governed, as illustrated in FIGS. 1 and 2, by the temperature of the air carrying the cotton lint, the heat coming from hot air conduits 28, the ambient temperature and, to a lesser extent, heat from second shelves 4. As illustrated in FIGS. 1 and 2, the gradient is preferably adjusted through hot air conduits 28. Hot air conduits 28 transfer heat from hot air passing through them to the air within tower 38. Hot air pumped through hot air conduits 28 starts at top portion 34 of tower 38 and proceeds, as it heats tower 38 and thereby cools, to hot air conduits 28 located in bottom portion 36. Thus, top portion 34 receives the most heat and, progressively, bottom portion 36 receives the least heat from hot air conduits 28. The temperature gradient between the top and bottom portions 34 and 36 is made even steeper by placing a greater number of hot air conduits 28 in top portion 34 than bottom portion 36. When the cotton lint finally advances out of tower 38, it may have cooled to nearly the ambient temperature of the atmosphere surrounding tower 38, which is usually located outdoors. Preferably, the cotton lint will be at about the ambient temperature, however, it will depend greatly upon the weather—during the winter the cotton lint is less likely to have cooled to ambient temperature than during the summer.

The temperature gradient and difference between the first temperature of top portion 34 and the second temperature of bottom portion 36 is easier to control if the ambient temperatures is cool. High ambient temperatures can reduce the effectiveness of the process by decreasing the temperature drop of humid air 24, thereby reducing the amount of water condensed onto the cotton lint. When the outside ambient temperature is not low enough to condense enough moisture out of humid air 24, additional humid air may be blown over the cotton lint after has been processed in the battery condenser, this is not, however, ideal, as wear and tear on the battery ram and tamper will not be eased as much as if the ambient temperature is lower. Thus, if the ambient temperature is very high, it is preferred to either perform this process in the evening or night when the ambient temperature is lower, or to increase the temperature of humid air 24 and the first temperature to compensate.

Returning to the movement of the cotton lint through passage 10, it is preferred that the major force acting to advance humid air 24 and the cotton lint is positive air pressure, as illustrated in FIGS. 1 and 2, because it has proven to be a reliable means for advancing cotton lint. Positive air pressure is preferably supplied by the air carrying the cotton lint out of lint flue 30 and the pressure from moisture line 20. The positive air pressure is supplied to and flows out of lint flue 30 and is supplied by humidifier 26 by moisture line 20 through two second inlets 12 and 14. This positive pressure advances the air, and thus the cotton lint, within tower casing 2 from first inlet 8 to outlet 32. Tower 38 is constructed such that gravity also assists the cotton lint from top portion 34 to bottom portion 36, but it is not the major force.

It will be apparent to those skilled in the art that various modifications can be made in the step of advancing cotton along a sinuous passage. For example, instead of positive air pressure and gravity, the step of advancing cotton along a sinuous passage may include using a conveyer belt. Further, instead of both air pressure and gravity, just gravity or just air pressure may be used.

Generally, this method may be used at any stage of a ginning process, however, it is most useful after cotton has been cleaned by a lint cleaner and/or gin stand and before the cotton is processed by a battery condenser.

In accordance with the present invention, an apparatus for adding moisture comprises a tower casing defining a chamber having top and bottom portions, a first inlet proximate the top portion of the tower casing for receiving the cotton, an outlet proximate the bottom portion, a cotton conveying passage connecting the first inlet to the outlet, and a second inlet to the top portion for receiving the humid air.

In the illustrated embodiment shown in FIGS. 1 and 2, tower casing 2 is a large rectangular box made of sheet metal, which contains an internal structure supporting seven heated second shelves 4 and two unheated first shelves 6. Casing 2 also contains openings for two humid air inlets 12 and 14, first inlet 8 for cotton lint, and outlet 32 for cotton lint. Casing 2 may be constructed of many different materials so long as the material is capable of withstanding humid air, heat, and cotton lint while being strong enough to provide the passage described below. While a tower is preferred because it is easy to construct and has a large volume to surface area ratio, thereby having low energy loss coefficient, a tower structure is not necessary to the invention. Thus, while tower casing 2 is depicted as rectangular in cross-section, other probable structural shapes that would suffice include a cylinder, a pyramid, a cone, or others.

In the preferred embodiment shown in FIGS. 1 and 2, first inlet 8 is a sheet metal tube about one and a half feet in diameter, but may be of a different cross-sectional area and also may be rectangular in cross-section. It may be made of high temperature plastic or glass, as well as other materials well known in the art.

In accordance with the present invention, the apparatus for adding moisture to cotton using humid air comprises a cotton conveying passage connecting the first inlet to the outlet.

As illustrated in FIGS. 1 and 2, the preferred embodiment of cotton conveying passage 10 is a sinuous passage beginning with high potential energy to allow for a gravity-assisted flow of cotton lint, where shelves 4 and 6 and tower casing 2 govern the sinuous of passage 10. Alternatively, passage 10 may have a gentle turning angle at the elbows of the sinuous with a downhill slope to the passage, spiral shape, or another shape that allows for cotton lint to travel through a temperature gradient.

In accordance with the present invention, the apparatus for adding moisture to cotton using humid air further comprises a second inlet in the tower casing for receiving the humid air.

Preferably, as illustrated in FIGS. 1 and 2, the second inlet includes two inlets, 12 and 14, both of which are five inches in diameter and accept corresponding moisture line branches 16 and 18, respectively. Second inlets 12 and 14 may have a much larger diameter than five inches or much smaller, or may have a square, oblique, or other cross-section so long as the inlet and nozzle 22 are constructed to provide humid air from humidifier 26 to tower 38 at a positive pressure. As illustrated in FIGS. 1 and 2, it is preferred that second inlet include two inlets, one introducing humid air 24 between first shelves 6, and another introducing humid air 24 between one first shelf 6 and one second shelf 4. Preferably second inlets 12 and 14 connect to moisture line 20 through branches 16 and 18, respectively, which are connected to humidifier 26. Lastly, it is preferred that second inlets 12 and 14 include nozzles which restrict the cross-section of humid air 24 to increase its positive pressure and to direct humid air 24 to flow in about the same direction as the cotton lint is flowing. Alternatively, humid air 24 may be introduced through many second inlets throughout tower 38.

In accordance with the present invention, the apparatus for adding moisture to cotton using humid air further comprises shelves projecting into the chamber that are heated to predetermined temperatures.

Preferably, second shelves 4 are heated by circulation of propane burner-heated air through the interior of shelves 4. Other methods of heating shelves 4, however, may be used as well.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of increasing the moisture content of cotton, comprising the steps of:

introducing cotton into a chamber having a plurality of surfaces;

heating at least one of the plurality of surfaces;

introducing humid air at a temperature greater than the ambient air temperature into the chamber; and exposing the cotton to the humid air to apply moisture to the cotton by moving the humid air and cotton from a first temperature region to a second temperature region, the first temperature region having a temperature of about 25° to 50° higher than the temperature of the second temperature region.

2. The method of claim 1, wherein the exposing step includes moving the humid air and cotton from an inlet of the chamber to an outlet of the chamber.

3. The method of claim 1, wherein the exposing step includes moving the cotton along a sinuous path defined by the position of the plurality of surfaces by an air flow.

4. The method of claim 1, wherein the heating step includes heating the surfaces proximate the inlet of the chamber to a temperature sufficient to substantially prevent hydroadhesion on the surfaces.

5. The method of claim 1, wherein the introducing humid air step includes providing a liquid mist.

6. The method of claim 1, further comprising the step of:

positioning the chamber in a ginning process to add moisture to lint cotton.

7. The method of claim 1, wherein the heating step includes heating the at least one surface to a temperature greater than that of the cotton.

8. An apparatus for adding moisture to cotton using humid air, comprising:

a tower casing defining a chamber having top and bottom portions;

a first inlet for receiving the cotton;

an outlet for expelling the cotton, wherein the temperature proximate the first inlet is about 25°–50° F. higher than the temperature proximate the outlet;

a conveying passage connecting the first inlet to the outlet, the conveying passage defined by surfaces disposed in the chamber, wherein at least one of the surfaces is heated to a temperature greater than that of the cotton and sufficient to substantially prevent hydroadhesion on the at least one surface; and a second inlet for receiving the humid air.

9. The apparatus of claim 8, wherein the conveying passage is defined by surfaces alternatively projecting into the chamber to define a sinuous path.

10. The apparatus of claim 8, wherein the tower casing is positioned in the cotton ginning process at a location to add moisture to lint cotton.

11. The apparatus of claim 8, wherein the cotton is conveyed through the chamber by an air flow.

* * * * *